US005797655A

United States Patent [19]

Miles

[11] Patent Number: 5,797,655

[45] Date of Patent: Aug. 25, 1998

[54] ATTACHABLE ARM REST FOR CHAIRS

[76] Inventor: Ralph Miles, 1 Gate House La., Mamaroneck, N.Y. 10543

[21] Appl. No.: 890,110

[22] Filed: Jul. 9, 1997

[51] Int. Cl.[6] ..... A47C 7/54; B60N 2/46

[52] U.S. Cl. ..... 297/411.23; 297/411.24; 297/411.25; 297/411.35; 297/411.38; 297/188.14; 297/188.17; 297/31; 297/35; 297/348.18; 297/DIG. 6; 248/118

[58] Field of Search ..... 297/411.23, 411.24, 297/411.25, 411.28, 411.35, 411.38, 188.14, 188.17, 344.18, 31, 35, DIG. 6, 440.1; 248/118

[56] References Cited

U.S. PATENT DOCUMENTS

| | | | |
|---|---|---|---|
| 329,140 | 10/1885 | Clarke | 248/118 X |
| 915,047 | 3/1909 | Smith | 248/118 |
| 2,491,009 | 12/1949 | Lawrence | 297/411.23 |
| 2,642,117 | 6/1953 | Glauber . | |
| 2,658,560 | 11/1953 | Cawthon . | |
| 2,659,423 | 11/1953 | Haley . | |
| 2,699,203 | 1/1955 | White | 297/411.23 |
| 2,751,968 | 6/1956 | Fleming . | |
| 2,781,828 | 2/1957 | Ferrar | 297/411.23 |
| 3,068,048 | 12/1962 | Mahon et al. . | |
| 3,206,249 | 9/1965 | Gateley | 297/411.23 |
| 3,233,939 | 2/1966 | Chapman | 297/411.23 X |
| 3,265,436 | 8/1966 | La Bombard et al. . | |
| 3,565,484 | 2/1971 | Dargelo | 297/411.28 X |
| 4,913,393 | 4/1990 | Wood | 297/411.23 X |
| 4,948,197 | 8/1990 | Sansing | 297/188.14 |
| 5,234,251 | 8/1993 | Ayotte | 297/188.14 |
| 5,302,000 | 4/1994 | Ayotte | 297/188.14 X |
| 5,332,288 | 7/1994 | Coates | 297/411.26 X |
| 5,393,125 | 2/1995 | Watson et al. | 297/344.18 X |
| 5,402,972 | 4/1995 | Schmidt | 248/118 |
| 5,439,268 | 8/1995 | Dozsa-Faikas | 297/411.35 |
| 5,533,782 | 7/1996 | Goldman | 297/188.14 X |
| 5,588,697 | 12/1996 | Yoshida et al. | 297/188.17 X |

*Primary Examiner*—Peter M. Cuomo
*Assistant Examiner*—Rodney B. White
*Attorney, Agent, or Firm*—Darby & Darby

[57] ABSTRACT

An adjustable arm rest device for chairs includes a lower arm rest, an upper arm rest connected to the lower arm rest by an intermediate member and adjustable to a selected angular orientation relative to the arm rest, at least one fastener for removably securing the first and second portions to a frame of the chair in the selected angular orientation, and a leg for supporting the arm rest on a surface. The arm rest device is readily attachable to the frames of chairs, and is adjustable for use with adjustable chairs such as lounge chairs.

16 Claims, 4 Drawing Sheets

ATTACHABLE ARM REST FOR CHAIRS

FIELD OF THE INVENTION

The present invention relates generally to the field of accessories for chairs, and in particular to arm rests for chairs.

BACKGROUND OF THE INVENTION

Lounge chairs, that is, elongated and typically foldable and adjustable chairs are common furniture for lawns and patios. Some designs of lounge chairs include integral chair arms for accommodating the arms of a person. Other designs forego such chair arms. Therefore, people using lounge chairs without arm rests are limited in placement of their arms, and so may experience discomfort. Accordingly, a need exists for a lounge chair accessory to provide an arm rest for a lounge chair not having an integral arm rest, to accommodate the comfort of each user.

Arm rest devices are known in the art for use in vehicles such as automobiles. For example, each of U.S. Pat. Nos. 2,658,560; 2,659,423; 2,751,968; 3,068,048; and 5,302,000 describes a single rigid arm rest which may be positioned in a central location upon or between car seats to accommodate either a driver or a passenger.

Other arm rest devices are known in the art which may be attached to chairs. For example, U.S. Pat. Nos. 2,642,117 and 3,206,249 describe arm rests for chairs and/or for use with toilets. U.S. Pat. No. 3,265,436 describes a tray attachment for a chair. Such devices are rigid and are securely attached to a chair or chair-like structure using nut-and-bolt arrangements.

Heretofore, the rigidity of such arm rest devices have prevented their applicability to adjustable chairs, such as folding and adjustable reclining lounge chairs. Accordingly, a need exists for adjustable arm rest devices adaptable to adjustable chairs, such as lounge chairs.

In addition, the manner of securing such arm rest devices to chairs generally involves nut-and-bolt arrangements which are not easily secured or removed without tools and labor. Accordingly, a need exists for arm rest devices which may be readily attachable and detachable to chairs, such as lounge chairs.

SUMMARY OF THE INVENTION

It is recognized herein that a readily attachable arm rest device may be provided which is adjustable for use with adjustable chairs such as lounge chairs.

An adjustable arm rest for chairs is disclosed which includes a lower arm rest; an upper arm rest connected to the lower arm rest by an intermediate member and adjustable to a selected angular orientation relative to the arm rest, at least one fastener for removably securing the first and second portions to a frame of the chair in the selected angular orientation, and a leg for supporting the arm rest on a surface.

BRIEF DESCRIPTION OF THE DRAWINGS

The features and advantages of the disclosed adjustable arm rest device are readily apparent and are to be understood by referring to the following detailed description of the preferred embodiments of the present invention, taken in conjunction with the accompanying drawings, in which.

DESCRIPTION OF THE PREFERRED EMBODIMENTS

Figure 1:
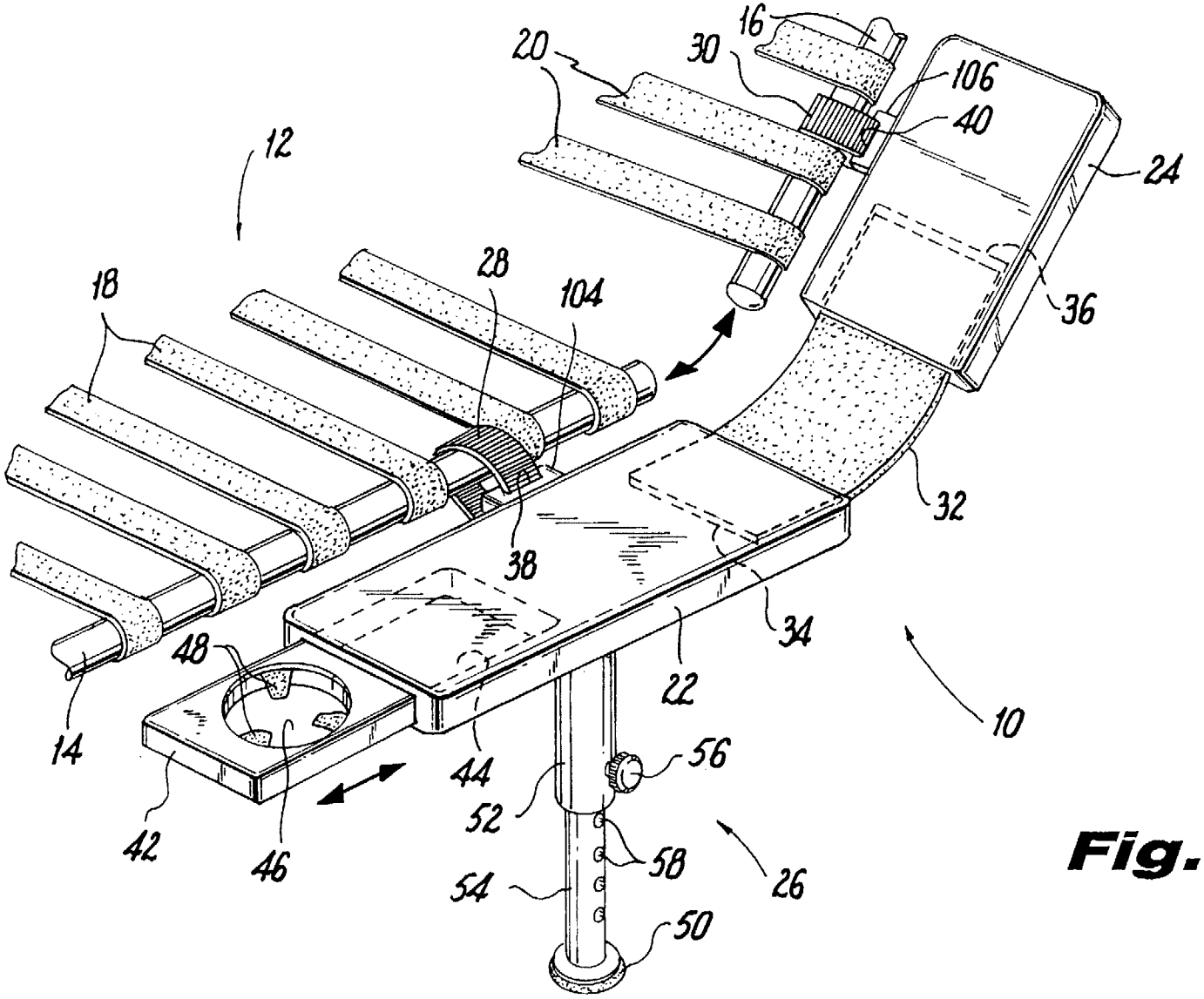
FIG. 1 is a perspective view of the disclosed arm rest device.

Referring in specific detail to the drawings, with common reference numbers identifying similar or identical elements, steps, and features, as shown in FIG. 1, the present disclosure describes an adjustable arm rest device 10 for use with chairs, and in particular lounge chairs. In the illustrative embodiment shown in FIG. 1, adjustable arm rest device 10 is removably attached to lounge chair 12 (a portion of which is shown in FIG. 1) having an upper portion which serves as a back or backrest, and a lower portion which serves as a seat or base. As with a typical lounge chair, lounge chair 12 includes lower frame 14 and upper frame 16 with rungs 18, 20 extending from one side of lounge chair 12 to the other.

Frames 14, 16 may be attached in a hinged arrangement which permits lounge chair 12 to be folded and/or adjustable. Alternatively, frames 14, 16 may be integrally fused together in a fixed angular configuration to each other. Frames 14, 16 may be tubular or solid, and rungs 18, 20 may be plastic tubing, strips, plastic, or textile webbing. Alternatively, lounge chair 12 may have frames 14, 16 and rungs 18, 20 composed of wood and/or plastic.

Arm rest device 10 includes lower arm rest 22, upper arm rest 24 connected to lower arm rest 22 by intermediate member 32, leg 26 attached to lower arm rest 22, and fasteners 28, 30 for attaching arm rest device 10 to lounge chair 12. Upper arm rest 24 may slidably engage the intermediate member 32 disposed within cavities 34, 36 (shown in phantom in FIG. 1) of arm rests 22, 24. Cavities 34, 36 may be dimensioned to allow intermediate member 32 to be extended and retracted partially or even fully therein, such that lower arm rest 22 and upper arm rest 24 may be moved apart to different positions.

Figure 6:
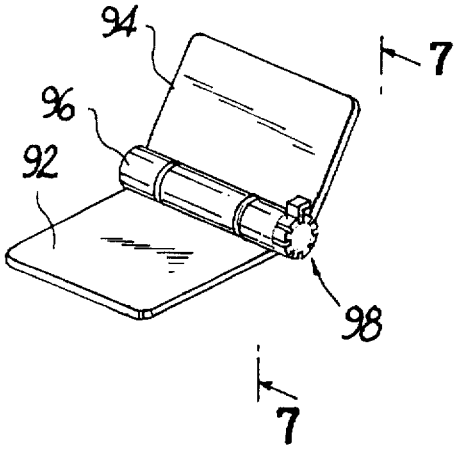
FIG. 6 is a perspective view of an alternative embodiment of an intermediate member.
Figure 7:
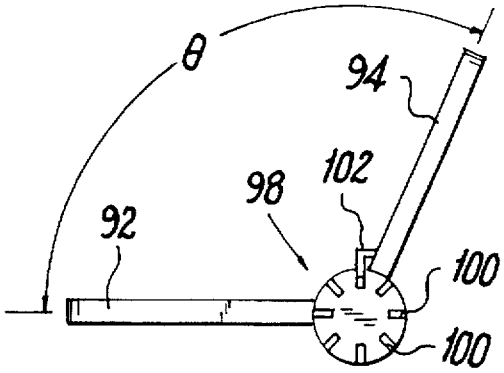
FIG. 7 is a side plan view of the intermediate member along lines 6—6 of FIG. 6.

Intermediate member 32 may be flexible, allowing upper arm rest 24 to be positioned at an angle to lower arm rest 22. Intermediate member 32 may be composed of bendable plastic, a fabric web, etc. to be adjustable to attain a predetermined or selected angular orientation from a range of angular orientations, such that arm rests 22, 24 attached to intermediate member 32 have a corresponding predetermined or selected angular orientation. In an alternative embodiment, intermediate member 32 may include at least a pair of planar members 92, 94 connected to hinge 96, with planar member 92 inserted into cavity 34 of lower arm rest 22, and planar member 94 inserted into cavity 36 of upper arm rest 24 such that upper arm rest 24 may be adjusted to be oriented and fixed in a predetermined or selected angle to lower arm rest 22. For example, as shown in FIGS. 6–7, hinge 96 may include an adjustable ratchet and pawl mechanism in the form of cylindrical disk 98 having sockets 100, with pawl 102 engaging one of sockets 100 to affix upper arm rest 24 at a selectable angle 0 to lower arm rest 22.

In further alternative embodiments, intermediate member 32 may be a rigid component composed, for example, of rigid plastic, metal, etc. to configure lower arm rest 22 and upper arm rest 24 in a fixed angular orientation. Using the ratchet and pawl mechanism for locking arm rests 22, 24 into a fixed orientation and/or using rigid intermediate member 32, arm rest device 10 has substantial rigidity to prevent lower arm rest 22 from rolling and/or pitching as a user rests a lower arm thereupon.

Using flexible and/or adjustable intermediate member 32, arm rest device 10 may be adjusted to have an angular orientation of arm rests 22, 24 thereof substantially matching an angular orientation of the portions of lounge chair 12, as shown in FIG. 1. With substantially matching angular orientations between arm rest device 10 and lounge chair 12, arm rest device 10 is attachable to lounge chair 12 by fasteners 28, 30.

In a preferred embodiment, fasteners 28, 30 are composed of flexible bands having hook-and-loop fasteners known in the art, such as commercially available "VELCRO" fasteners. The flexible bands of fasteners 28, 30 are looped through respective slots 38, 40 of arm rests 22, 24, and loop around respective frames 14, 16 of lounge chair 12. Adjustment of flexible bands to form loops of narrower or wider curvature, for example, to substantially match the curvature of the cross-sections of frames 14, 16, allows fasteners 28, 30 to be secured to frames 14, 16. The looping of the flexible bands between rungs 18, 20 of lounge chair 12 to respectively rest against at least one rung prevents fasteners 28, 30 from moving vertically and/or horizontally. Accordingly, arm rests 22, 24 of arm rest device 10 may be secured to lounge chair 12 in a fixed position on frames 14, 16.

Since fasteners 28, 30 are both flexible and composed of such hook-and-loop fasteners, fasteners 28, 30 are removably securable to frames 14, 16, respectively, which allows arm rest device 10 to be portable, adaptable to different lounge chairs, and adjustable to different angular configurations of a subject lounge chair. In addition, since each of fasteners 28, 30 is independent of each other, as one fastener is secured to its respective frame, the other fastener may be left unsecured from its respective frame for adjustment or for optionally leaving a respective one of arm rests 22, 24 unattached to lounge chair 12.

For example, fastener 28 may secure lower arm rest 22 to lower frame 14, while the other fastener 30 is unused, allowing upper arm rest 24 to be unattached to lounge chair 12. Alternatively, both fasteners 28, 30 may be secured to a single frame of lounge chair 12, for example, to lower frame 14. Such attachment to a single frame allows arm rests 22, 24 of arm rest device 10 to form a single arm rest which may be, for example, substantially contiguous, substantially planar, and/or extending along a longitudinal length of a single frame such as, for example, lower frame 14.

Accordingly, as shown in FIG. I in one configuration, arm rest device 10 may have lower arm rest 22 attached to lower frame 14 for resting a lower arm of a user, while upper arm rest 24 attached to upper frame 16 may be positioned for resting an upper arm and/or shoulder of user sitting in lounge chair 12. Alternatively, with both arm rests 22, 24 attached to only frame 14, or with one arm rest 22 attached to lower frame 14 with arm rest 24 is left unattached, arm rest device 10 is configured to rest only a lower arm of user. Still further alternative configurations may include one or both of arm rests 22, 24 attached to only frame 16 and unattached to frame 14 to configure arm rest device 10 solely as an upper arm and/or shoulder rest for a user disposed in lounge chair 12.

Slots 38, 40 through which are looped flexible bands may be cavities formed in respective elements 104, 106 protruding from respective sides of arm rests 22, 24 of arm rest device 10. Protruding elements 104, 106 may include a swivel ball joint for swivelling about an axis such that, for example, fastener 30 may be angularly oriented to be attached to an upper portion of lounge chair 12.

Arm rest device 10 may also have such elements 104, 106 with slots 38, 40 on both lateral sides of arm rests 22, 24 to permit arm rest device 10 to be positioned and removably secured on either side of lounge chair 12. Alternatively, slots 38, 40 may extend through arm rests 22, 24 via cavities therein without protruding elements 104, 106.

In other alternative embodiments, fasteners 28, 30 may include flexible bands having complementary snapping/two-part interlocking fasteners, clamps, zippers, straps, bungee ties, etc., such that fasteners 28, 30 may be removably and readily secured to and thereafter readily removed from frames 14, 16 of lounge chair 12.

While fasteners 28, 30 through respective slots 38, 40 are shown in FIG. 1, it is to be understood that M fasteners and N fastener slots may be provided, in which $1 \leqq M \leqq N$. In one embodiment, there may be a plurality of fasteners 28, 30 and an identical number of corresponding fastener slots 38, 40. In another embodiment, a plurality of fastener slots may be positioned along lengths of arm rests 22, 24, and the number of fasteners 28, 30 may be arbitrary, such that the locations for extending fasteners 28, 30 through available fastener slots may be determined by the user to configure and secure arm rests 22, 24 in arbitrary configurations in a secured relation to lounge chair 12.

Fasteners 28, 30 may be provided with arm rest device 10, or may be provided and/or sold separately. Accordingly, separately available fasteners and/or compatible fastening devices such as flexible bands may be used as replacement fasteners in case of damage or wear of such fasteners originally provided with arm rest device 10. In another alternative embodiment, fasteners 28, 30 may be secured and/or removably secured to elements having slots 38, 40.

In an additional embodiment, fasteners 28, 30 may be pivotally connected to an element without slots which protrudes from a side of a respective one of arm rests 22, 24. Accordingly, fasteners 28, 30 may attain any angular orientation relative to a respective one of arm rests 22, 24 to be oriented to be securely fastened to a respective one of frames 14, 16.

Lower arm rest 22 may include extendable member 42 capable of extending from and retracting into cavity 44 of lower arm rest 22. Extendable member 42 may be planar for providing an adjustable and customizable overall length of lower arm rest 22 for accommodating the arms of a user and for providing comfort to the user sitting in lounge chair 12. Alternatively, as shown in FIG. 1, extendable member 42 may include aperture 46 and optionally flanges 48 for holding accessories such as beverage containers, including cups and glasses, as well as cylindrical devices of any predetermined cross-section such as circular or rectangular pencil holders, in a retractable cup holder configuration.

Figure 8:
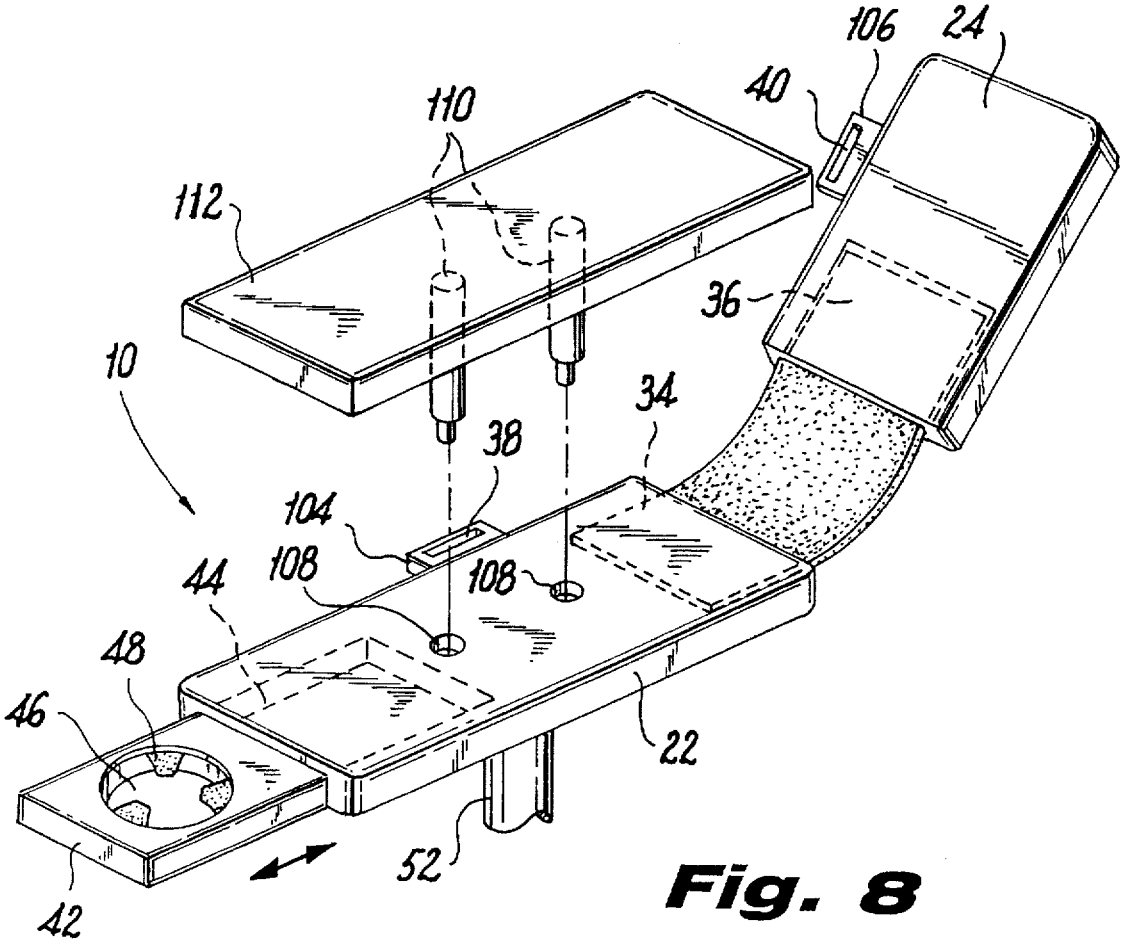
FIG. 8 is a perspective view of an alternative embodiment of the disclosed arm rest device.

In a further embodiment shown in FIG. 8, lower arm rest 22 may include at least one aperture 108 for receiving at least one support leg 110 of raised arm rest 112. Accordingly, with lower arm rest 22 attached to and positioned substantially parallel to a lower portion of lounge chair 12, as illustrated in FIG. 1, raised arm rest 112 is positioned to accommodate the lower arm of a user lying in lounge chair 12. Raised arm rest 112 may be composed of a substrate and upholstery, as described above for lower arm rest 22. In addition, support leg 110 may be adjustable in a manner similar to leg 26 described above, for example, using telescoping members, for adjusting the height of raised arm rest 112 over lower arm rest 22 and thus over the lower portion of lounge chair 12.

The height of raised arm rest 112, which may be adjustable, may be used in conjunction with adjustments to the angle between upper and lower portions of lounge chair 12 and/or arm rests 22, 24, as described above. For example, as a user changes the angle between upper and lower portions of lounge chair 12, the height and position of the lower arm of the user lying in lounge chair 12 also changes. The use of raised arm rest 112 accommodates such changes in height and position of the lower arm of the user, thus contributing to the overall comfort of the user. Thus, the use of raised arm rest 112 is adaptable to different lounge chairs, different configurations of lounge chair 12, and different users.

In use, lounge chair 12 may have two arm rest devices 10 on either side with identical or different configurations. For example, one side of lounge chair 12 may include retractable the cup holder feature, while other side may lack the retractable cup holder feature. Accordingly, a user may choose a configuration to match one's choice of beverage-holding hand; that is, a user may prefer to position one's cup on one's right hand side while sitting in lounge chair 12, and so an appropriate arm rest device 10 having the retractable cup holder feature may be positioned on the right hand side.

Leg 26 may be a solid member having base element 50 and connected to underside of lower arm rest 22 for supporting lower arm rest 22 and therefore arm rest device 10 above a surface, such as a floor, ground, a patio deck, etc. Alternatively, as shown in FIG. 1, leg 26 includes first leg member 52 connected to second leg member 54 in a sliding engagement such that overall length of leg 26 may be adjusted to set the height of upper arm rest 22. The adjustable height allows a user to adjust arm rest device 10 for resting the arms of the user thereupon to suit the comfort demands of the user.

Second leg member 54 may be in a sliding telescopic arrangement with first leg member 52. For example, in the embodiment shown in FIG. 1, leg members 52, 54 may be tubular members with one leg member moving within the other leg member, such as second leg member 54 disposed for moving within first leg member 52.

As shown in FIG. 1, the overall length of leg 26 may be adjusted using, for example, adjustment knob 56 which selectively engages at least one hole 58 in, for example, second leg member 54 by passing through a hole in first leg member 52 (not shown in FIG. 1). Adjustment knob 56 may have a spring mechanism (not shown in FIG. 1) allowing an end of adjustment knob 56 to be moved out of its corresponding hole in second leg member 54 to permit movement of second leg member 54 to a different position within first leg member 52. The spring mechanism may then provide a restoring force to move the end of adjustment knob 56 into a different one of holes 58 to secure position of second leg member 54 in first leg member 52.

Alternatively, adjustment knob 56 may be rotatable and attached to a rotatable gear for engaging a set of teeth on second leg member 54 to move second leg member 54 vertically within first leg member 52. Further alternative embodiments may have adjustment knob 56 including a screw optionally having a knob on head of screw for facilitating turning screw thereof.

Figure 2:
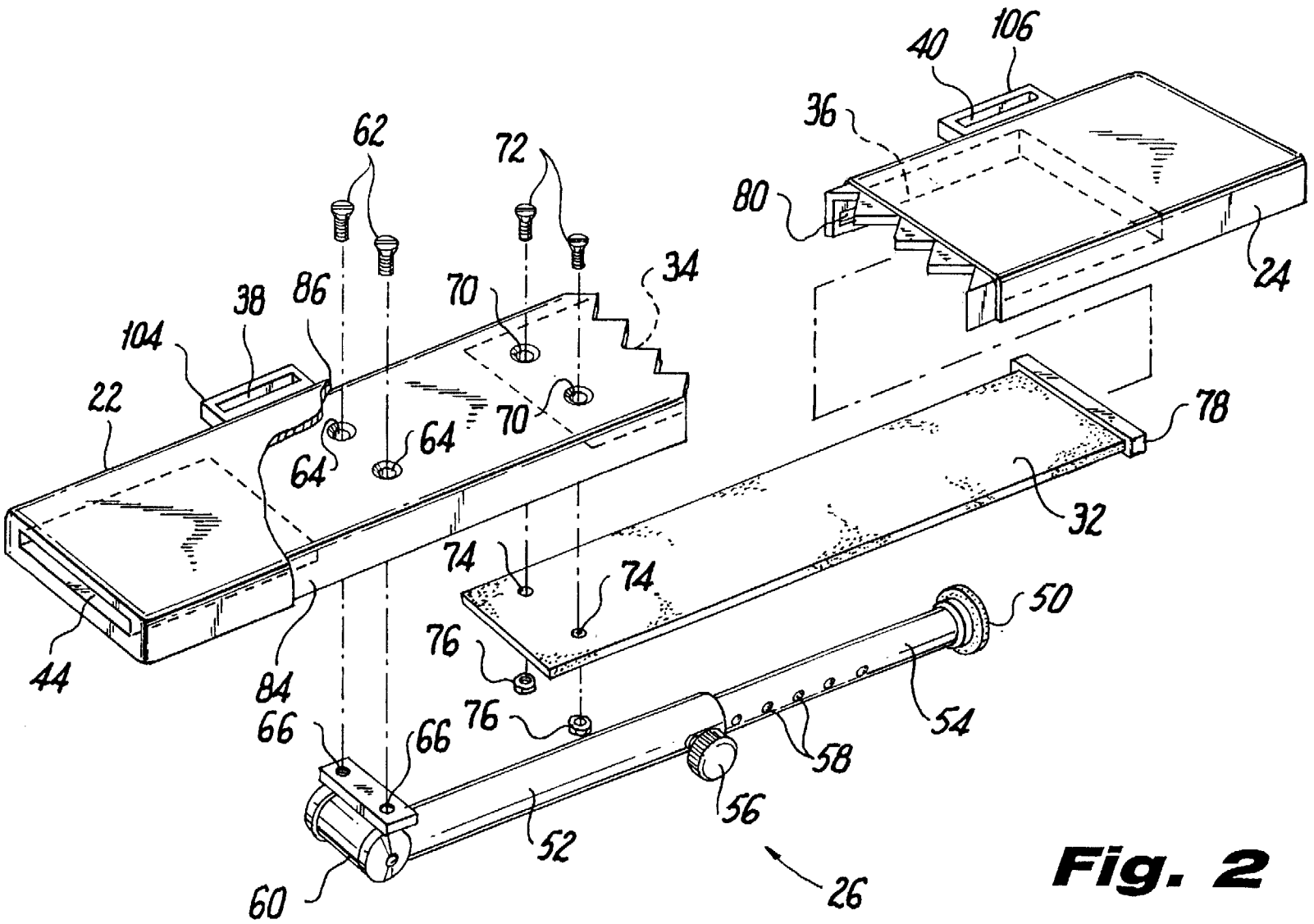
FIG. 2 is a perspective view with parts separated of the disclosed arm rest device.
Figure 3:
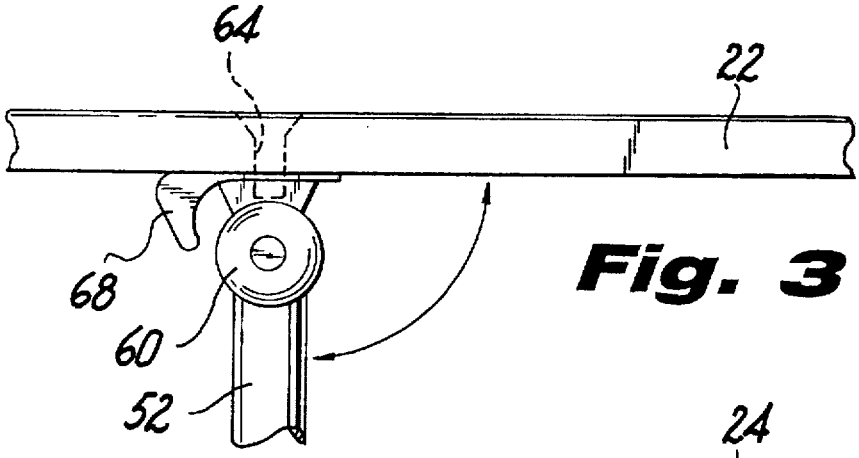
FIG. 3 is a aside plan view of a pivotal leg member.

As shown in FIG. 2, leg 26 may include pivotal base 60 for pivotally connecting leg 26 to the underside of lower arm rest 22 using screws 62 or optionally bolts extending through a first set of screw holes 64 in lower arm rest 22 to securely engage screw holes 66 in pivotal base 60. As shown in FIG. 3, pivotal base 60 may include leg stop 68 for preventing further pivoting of first leg member 52 so that leg 26 attains a substantially perpendicular orientation with a longitudinal surface of lower arm rest 22.

With leg 26 pivoted upward to lie substantially adjacent to lower arm rest 22, as shown in FIG. 2, arm rest device 10 is capable of attaining a relatively compact configuration for portability and storage between uses.

A second set of screw holes 70 in lower arm rest 22 are provided for passing therethrough a second set of screws 72 or optionally bolts to engage screw holes 74 in intermediate member 32 as well as nuts 76. Thus, a first end of intermediate member 32 is secured in cavity 44 to lower arm rest 22.

Figure 4:
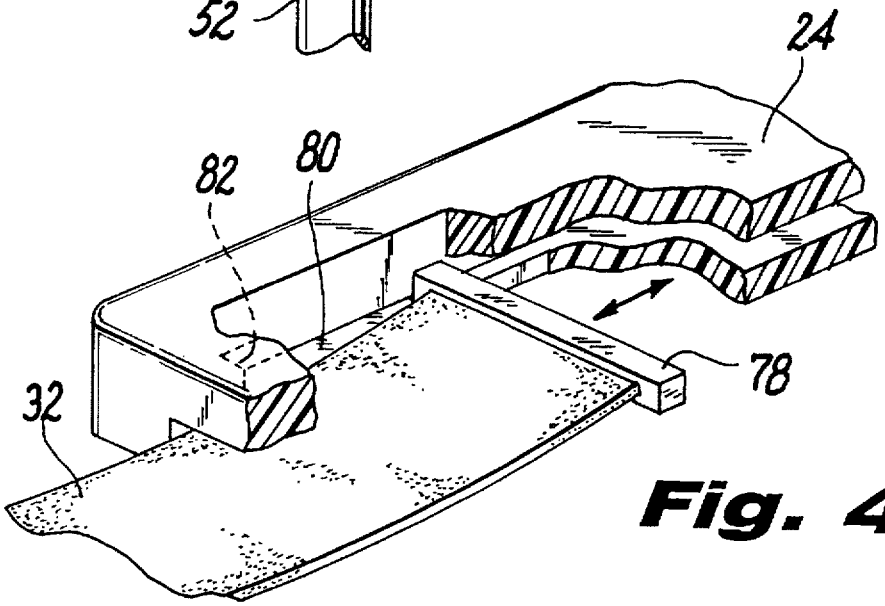
FIG. 4 is a perspective cut-away view of a slot engagement member slidably engaging a slot.

Referring to FIG. 2 in conjunction with FIG. 4, a second end of intermediate member 32 includes or has disposed thereupon slot engagement member 78 which is positioned to move and slidably engage elongated slot 80 within cavity 36 of upper arm rest 24. As shown in FIG. 4, as intermediate member 32 is moved within cavity 36, slot engagement member 78 slides within elongated slot 80 until slot engagement member 78 encounters at least one stop 82, which prevents intermediate member 32 from completely exiting cavity 36. In a preferred embodiment, both lateral sides of upper arm rest 24 includes a respective stop, with one such stop 82 shown in FIG. 4. Slot engagement member 78 and/or elongated slot 80 may be coated with polytetrafluoroethylene-based materials, such as "TEFLON", for reduced frictional contact.

As shown in FIG. 2, lower arm rest 22 includes substrate 84 through which pass screw holes 64, 70 and screws 62, 72. Upholstery 86 may then cover substrate 84 to hide screws 62, 72 and screw holes 64, 70 as well as to provide additional comfort to the user as the user lays an arm thereupon. Accordingly, upholstery 86 may be composed of fabric and/or leather. Alternatively, plastic covers may be used for upholstery 86. In particular, fabric and/or plastic covers may have an elastic perimeter to be removably secured to respective arm rests 22, 24, and fabric and/or plastic covers may be readily washable. It is understood that upper arm rest 24 may also include a substrate with upholstery thereupon.

Figure 5:
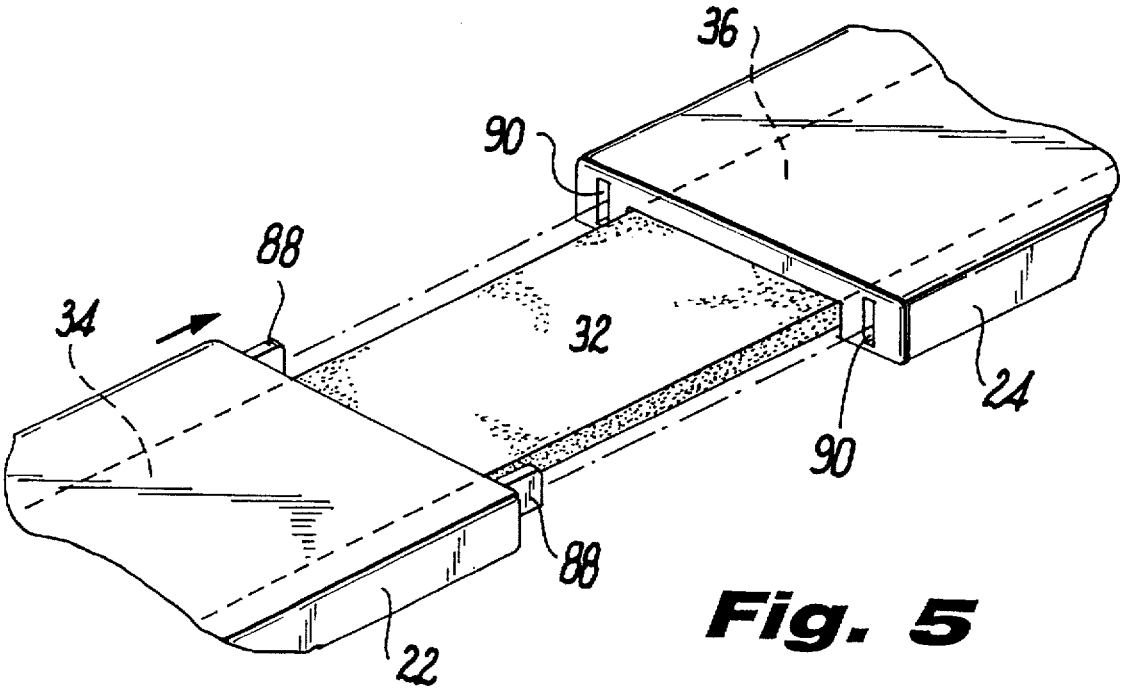
FIG. 5 is a perspective view of an alternative embodiment of the disclosed arm rest device.

In an alternative embodiment shown in FIG. 5, lower arm rest 22 may include protrusions 88 extending from a surface thereof toward upper arm rest 24, and so to enter corresponding apertures 90 in a surface of lower arm rest 24. When arm rests 22, 24 are moved together with intermediate member 32 fully disposed within cavities 34, 36, arm rests 22, 24 abut each other. In such an abutting configuration, protrusions 88 are positioned within apertures 90 to prevent movement of arm rests 22, 24 as a user rests an arm thereupon. Accordingly, protrusions 88 engaging corresponding apertures 90 provides a substantially contiguous surface along a joint between arm rests 22, 24.

In another alternative embodiment, protrusions 88 and apertures 90 may include a clamp and/or locking mechanism for locking protrusions 88 within apertures 90 until a minimum disengagement force is applied, for example, by user. Such a clamp and/or locking mechanism may have a threshold disengagement force, under which normal movement of an arm of a user resting thereupon does not disengage arm rests 22, 24, and so maintains a substantially contiguous surface between arm rests 22, 24. In addition, the use of complementary protrusions 88 and apertures 90 may maintain the compact configuration of arm rest device 10 when arm rests 22, 24 abut during storage and/or travel.

In use, arm rest device 10 may be readily and easily adjusted into arbitrary and customized configurations, depending upon the choice of the user. As leg 26 is pivotable and arm rests 22, 24 are movable to abut each other by the retraction of intermediate member 32 to be within cavities 34, 36, as well as extendable member 42 being retractable to be within cavity 44, arm rest device 10 may be folded and stored in a relative compact space, such as within a portable carrying case. In addition, hooks or clamps may be attached to either one of arm rests 22, 24 to removably attach arm rest device 10 in a folded configuration to the back or the bottom of lounge chair 12 when folded arm rest device 10 is not in use. Accordingly, arm rest device 10 may be temporarily stored with an associated lounge chair when not in use.

While arm rest device 10 is particularly shown and described herein with reference to the preferred embodiments, it is to be understood that various modifications in form and detail may be made without departing from the scope and spirit of the present invention. Accordingly, modifications such as any examples suggested herein, but not limited thereto, are to be considered within the scope of the present invention.

What is claimed is:

1. An adjustable arm rest device comprising:

a lower arm rest;

an upper arm rest adjustable to a selected angular orientation relative to the lower arm rest;

an intermediate member connecting the lower arm rest to the upper arm rest;

a pair of fasteners, each connected to a respective one of the upper and lower arm rests, for removably securing the lower and upper arm rests to a frame of a chair in the selected angular orientation; and a leg connected to the lower arm rest for supporting the lower arm rest on a surface.

2. The adjustable arm rest device of claim 1 wherein the leg is adjustable to a plurality of selectable positions to adjust the height of the lower arm rest from the surface.

3. The adjustable arm rest device of claim 1 wherein the leg is pivotally attached to the lower arm rest.

4. The adjustable arm rest device of claim 3 further comprising:

a leg stop for contacting the leg pivoted in a position substantially perpendicular to a longitudinal surface of the lower arm rest.

5. The adjustable arm rest device of claim 1 further comprising:

an extendable member disposed within a cavity of the lower arm rest for moving therein between an unextended position and at least one extended position.

6. The adjustable arm rest device of claim 5 wherein the extendable member includes an aperture adapted to hold a beverage container.

7. The adjustable arm rest device of claim 1 wherein the intermediate member connects the lower and upper arm rests in the selected angular orientation.

8. The adjustable arm rest device of claim 7 wherein the intermediate member slidably engages a slot within the upper arm rest to move the upper arm member in a plurality of positions relative to the lower arm rest.

9. The adjustable arm rest device of claim 8 wherein the intermediate member is flexible to attain a plurality of shapes to position the lower and upper arm rests in the selected angular orientation.

10. The adjustable arm rest device of claim 8 wherein the upper arm rest includes at least one aperture in a first surface; and wherein the lower arm rest includes at least one protrusion extending from a second surface and positioned to complementarily engage the at least one aperture of the upper arm rest when the first and second surfaces substantially abut each other.

11. The adjustable arm rest device of claim 8 wherein the intermediate member includes:

two planar elements, each planar element connected to a respective one of the lower arm rest and the upper arm rest; and a hinge connecting the two planar elements to attain a plurality of angular orientations therebetween.

12. The adjustable arm rest device of claim 11 further comprising:

a rachet-and-pawl mechanism for locking the hinge to lock the two planar elements in a selected angular orientation.

13. The adjustable arm rest device of claim 1 wherein the fastener includes hook-and-loop fastening elements.

14. The adjustable arm rest device of claim 1 wherein at least one of the lower and upper arm rests includes:

a substrate; and upholstery covering the substrate.

15. The adjustable arm rest device of claim 1 further comprising:

a raised arm rest having a leg member; and wherein the lower arm rest includes an aperture into which the leg member of the raised arm rest is disposed.

16. The adjustable arm rest device of claim 1 wherein the selected angular orientation substantially matches an angular orientation of a seat and a back of the chair.

* * * * *